US009476280B2

(12) United States Patent
Derby et al.

(10) Patent No.: US 9,476,280 B2
(45) Date of Patent: Oct. 25, 2016

(54) DOUBLE COMPRESSION SET PACKER

(71) Applicants: Michael C. Derby, Houston, TX (US); Brandon C. Goodman, Kingwood, TX (US)

(72) Inventors: Michael C. Derby, Houston, TX (US); Brandon C. Goodman, Kingwood, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 518 days.

(21) Appl. No.: 13/826,021

(22) Filed: Mar. 14, 2013

(65) Prior Publication Data

US 2014/0262350 A1 Sep. 18, 2014

(51) Int. Cl.
*E21B 33/12* (2006.01)
*E21B 33/128* (2006.01)

(52) U.S. Cl.
CPC ..... *E21B 33/128* (2013.01)

(58) Field of Classification Search
USPC ..... 166/387, 118, 119, 120
See application file for complete search history.

(56) References Cited

U.S. PATENT DOCUMENTS

| | | | | |
|---|---|---|---|---|
| 3,055,430 | A | 9/1962 | Campbell | |
| 3,460,616 | A * | 8/1969 | Crow et al. | 166/120 |
| 4,263,968 | A | 4/1981 | Garner, Jr. | |
| 4,279,306 | A | 7/1981 | Weitz | |
| 4,438,933 | A | 3/1984 | Zimmerman | |
| 4,834,175 | A | 5/1989 | Ross et al. | |
| 5,152,340 | A | 10/1992 | Clark et al. | |
| 5,277,253 | A | 1/1994 | Giroux et al. | |
| 5,810,082 | A | 9/1998 | Jordan, Jr. | |
| 6,612,372 | B1 | 9/2003 | Freiheit et al. | |
| 7,717,183 | B2 * | 5/2010 | Ezell | E21B 33/12 166/332.1 |
| 2009/0294137 | A1 * | 12/2009 | Meijer | E21B 33/1295 166/387 |
| 2010/0243235 | A1 | 9/2010 | Caldwell et al. | |
| 2011/0186307 | A1 | 8/2011 | Derby | |

FOREIGN PATENT DOCUMENTS

| | | | |
|---|---|---|---|
| CA | 2636195 | A1 | 7/2007 |
| WO | 2012068672 | A1 | 5/2012 |
| WO | 2013009458 | A2 | 1/2013 |

OTHER PUBLICATIONS

Schlumberger, "Model B and BL: Double-Grip Hydraulic-Set Packers," CoilTOOLS Catalog, undated.
Schlumberger, "Tandem Packers," CoilTOOLS Catalog, undated.
Weatherford, "Hydrow IV Hydraulic-Set Production Packer," Brochure, copyright 2008.
Weatherford, "WH-6 Hydraulic-Set Retrievable Packer," Brochure, copyright 2005-2007.
Weatherford, "Packer Systems," Catalog, copyright 2005.
Weatherford, "ThunderCat Hydraulic-Set Retrievable Production Packer," Brochure, copyright 2008-2009.

(Continued)

*Primary Examiner* — Sean Andrish
(74) *Attorney, Agent, or Firm* — Blank Rome LLP

(57) ABSTRACT

A device and method allow a longer sealing element to be used on a packer or other downhole tool while providing an increase in the total amount of setting force that can be used and providing for more uniform or balanced setting of the sealing element. The packer may be first set using internal bore pressure to radially expand one end of the sealing element with a first hydraulic setting mechanism. The packer may then be set a second time using annulus pressure to continue the radial expansion of the sealing element with a second hydraulic setting mechanism.

23 Claims, 5 Drawing Sheets

(56) References Cited

OTHER PUBLICATIONS

Weatherford, "PFH and PFHL Hydraulic/Hydrostatic Packers," Brochure, copyright 2007.
Weatherford, "UltraPak™ THH Permanent Packer," Brochure, copyright 2009.
Weatherford, "BlackCat Retrievable Sealbore Packer," Brochure, copyright 2005.
Weatherford, "BlackCat H and HU Hydraulic-Set Sealbore Production Packer," Brochure, copyright 2005.
Int'l Search Report and Written Opinion in counterpart PCT Appl. PCT/US2014/023128, mailed Jan. 12, 2015.
Patent Examination Report No. 1 for corresponding AU Patent Application No. 2014240992; dated Feb. 5, 2016; pp. 1-3.
Patent Examination Report No. 2 for corresponding AU Patent Application No. 2014240992, dated Jun. 22, 2016, 3-pgs.

* cited by examiner

DOUBLE COMPRESSION SET PACKER

BACKGROUND

In connection with the completion of oil and gas wells, it is frequently necessary to utilize packers in both open and cased bore holes. The walls of the well or casing are plugged or packed from time to time for a number of reasons. For example, a section of the well may be packed off to permit applying pressure to a particular section of the well, such as when fracturing a hydrocarbon bearing formation, while protecting the remainder of the well from the applied pressure.

In a staged frac operation, for example, multiple zones of a formation need to be isolated sequentially for treatment. To achieve this, operators install a fracture assembly 10 as shown in FIG. 1 in a wellbore 12. Typically, the assembly 10 has a top liner packer (not shown) supporting a tubing string 14 in the wellbore 12. Open hole packers 50 on the tubing string 14 isolate the wellbore 12 into zones 16A-C, and various sliding sleeves 20 on the tubing string 14 can selectively communicate the tubing string 14 with the various zones 16A-C. When the zones 16A-C do not need to be closed after opening, operators may use single shot sliding sleeves 20 for the frac treatment. These types of sleeves 20 are usually ball-actuated and lock open once actuated. Another type of sleeve 20 is also ball-actuated, but can be shifted closed after opening.

Initially, all of the sliding sleeves 20 are closed. Operators then deploy a setting ball to close a wellbore isolation valve (not shown), which seals off the downhole end of the tubing string 14. At this point, the packers 50 are hydraulically set by pumping fluid with a pump system 35 connected to the wellbore's rig 30. The build-up of tubing pressure in the tubing string 14 actuates the packers 50 to isolate the annulus 18 into the multiple zones 16A-C. With the packers 50 set, operators rig up fracturing surface equipment and pump fluid down the tubing string 14 to open a pressure actuated sleeve (not shown) so a first downhole zone (not shown) can be treated.

As the operation continues, operators drop successively larger balls down the tubing string 14 to open successive sleeves 20 and pump fluid to treat the separate zones 16A-C in stages. When a dropped ball meets its matching seat in a sliding sleeve 20, fluid is pumped by the pump system 35 down the tubing string 14 and forced against the seated ball. The pumped fluid forced against the seated ball shifts the sleeve 20 open. In turn, the seated ball diverts the pumped fluid out ports in the sleeve 20 to the surrounding annulus 18 between packers 50 and into the adjacent zone 16A-C and prevents the fluid from passing to lower zones 16A-C. By dropping successively increasing sized balls to actuate corresponding sleeves 20, operators can accurately treat each zone 16A-C up the wellbore 12.

The packers 50 typically have a first diameter to allow the packer 50 to be run into the wellbore 12 and have a second radially larger size to seal in the wellbore 12. The packer 50 typically consists of a mandrel about which the other portions of the packer 50 are assembled. A setting apparatus includes a port from the inner throughbore of the packer 50 to an interior cavity. The interior cavity may have a piston that is arranged to apply force either directly to a sealing element or to a rod or other force transmitter that will apply the force to the sealing element.

Typically, when the packer 50 is set, fluid pressure is applied from the surface via the tubular string 14 and typically through the bore of the tubular string 14. The fluid pressure is in turn applied through a port on the packer 50 to the packer's piston. The fluid pressure applied over the surface of the piston is then transmitted to the packer's sealing element to compress the sealing element longitudinally.

Most sealing elements are an elastomeric material, such as rubber. When the sealing element is compressed in one direction it expands in another. Therefore, as the sealing element is compressed longitudinally, it expands radially to form a seal with the well or casing wall.

In some situations, operators may want to utilize comparatively long sealing elements in their packers 50. In these instances, however, as the packer's piston pushes the sealing element to compress the sealing element longitudinally, friction and other forces combine to cause the sealing element to bunch up or otherwise bind near the packer's piston, preventing the sealing element from uniformly compressing longitudinally and thereby preventing the uniform radial expansion of the sealing element. The lack of uniform expansion tends to prevent the packer 50 from forming a seal that meets the operator's expectations, thereby defeating the purpose of utilizing a longer sealing element. For this reason, operators may not use an unset sealing element on a packer 50 that is more than about 24-inches long. Instead, a typical length of an unset seal element is only about 10-inches.

Therefore, a need exists for a packer that is able to utilize an extended length sealing element. The present invention fulfills these needs and provides further related advantages.

SUMMARY

A dual-set hydraulic packer disclosed herein allows a sealing element to be set from both ends so that more setting force and more uniform or balance setting can be applied to the sealing element. The sealing element can be relatively longer than conventionally used. Firstly, the packer is set by applying fluid pressure through the interior throughbore of the packer's mandrel to a first piston on an end of the sealing element. Then secondly, the packer is set by using pressure in the annulus to set a second piston on the other end of the sealing element. The setting order depends upon the desire of the operator because the packer can be installed either with the annular set piston on top and the tubular set piston on the bottom or vice versa.

Accordingly, the disclosed packer has an upper hydraulic setting mechanism, a lower hydraulic setting mechanism, and a sealing element disposed therebetween. The sealing element is sequentially longitudinally compressed separately by the upper hydraulic setting mechanism and the lower hydraulic setting mechanism so that the sealing element experiences compression from both ends during a fracture treatment, acid stimulation, or other operation or treatment where the pressure in a zone is increased.

The packer may have a mandrel with an interior and an exterior. The upper hydraulic setting mechanism, the lower hydraulic setting mechanism, and the sealing element are attached to the exterior of the mandrel. Fluid pressure in the mandrel interior typically actuates one or the other of the upper hydraulic setting mechanism or the lower hydraulic setting mechanism, but not both. Also, fluid pressure on the mandrel exterior typically actuates one or the other of the upper hydraulic setting mechanism or the lower hydraulic setting mechanism but not both.

The packer may have one or more sealing elements. In one embodiment, the packer may have at least two sealing elements separated by a barrier. The upper hydraulic setting mechanism may have a first piston adjacent to a first of the sealing elements, and the lower hydraulic setting mechanism may have a second piston adjacent to a second of the sealing elements. During operation, internal fluid pressure in the packer may act upon the first piston to radially expand a portion of (or the entire extent of) the sealing element(s). Additionally, external fluid pressure in the surrounding annulus may act upon the second piston to radially expand a portion of (or the entire extent of) the sealing element(s).

The packer may have a mandrel with an interior through-bore and an exterior. A first housing may be attached to a first end of the mandrel exterior and a second housing may be attached to a second end of the mandrel exterior. A first cylinder may be located within the first housing and a second cylinder may be located within the second housing. A first piston may be located within the first cylinder and the first piston is in fluid communication with the mandrel interior. A second piston may be located within the second cylinder and the second piston is in fluid communication with the mandrel exterior.

The first piston is disposed adjacent to the sealing element and the second piston is also disposed adjacent to the sealing element. Fluid pressure acts upon the first piston or the second piston to radially expand a portion of the sealing element. The first cylinder may be located between the first housing and the mandrel. The second cylinder may be located between the second housing and the mandrel.

In use, a packer having an interior, an exterior, a first hydraulic actuating mechanism, and a second hydraulic actuating mechanism may be run into a well. The interior of the packer is pressurized to actuate the first hydraulic actuating mechanism causing the sealing element to radially expand. The exterior of the packer is then pressurized to actuate the second hydraulic actuating mechanism causing the sealing element to radially expand.

As used herein, the terms such as lower, downward, downhole, and the like refer to a direction towards the bottom of the well, while the terms such as upper, upwards, uphole, and the like refer to a direction towards the surface. The uphole end is referred to and is depicted in the figures at the top of each page, while the downhole end is referred to and is depicted in the figures at the bottom of each page. This is done for illustrative purposes in the following figures. The tool may be run in a reverse orientation.

DETAILED DESCRIPTION

The description that follows includes exemplary apparatus, methods, techniques, and instruction sequences that embody techniques of the inventive subject matter. However, it is understood that the described embodiments may be practiced without these specific details.

Figure 1:
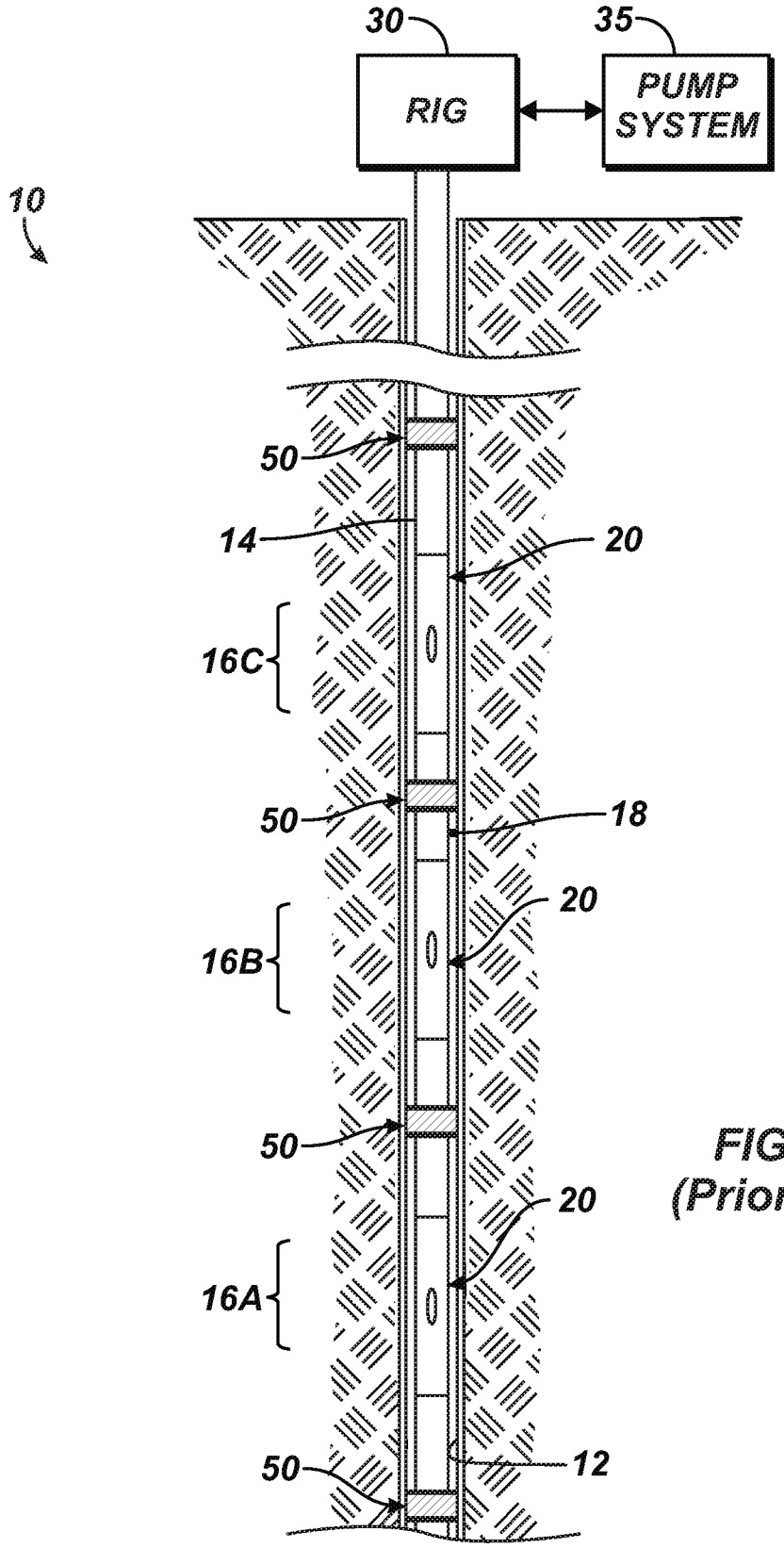
FIG. 1 (Prior Art)
FIG. 1 diagrammatically illustrates a tubing string having multiple sleeves and openhole packers of a fracture system.
Figure 2:
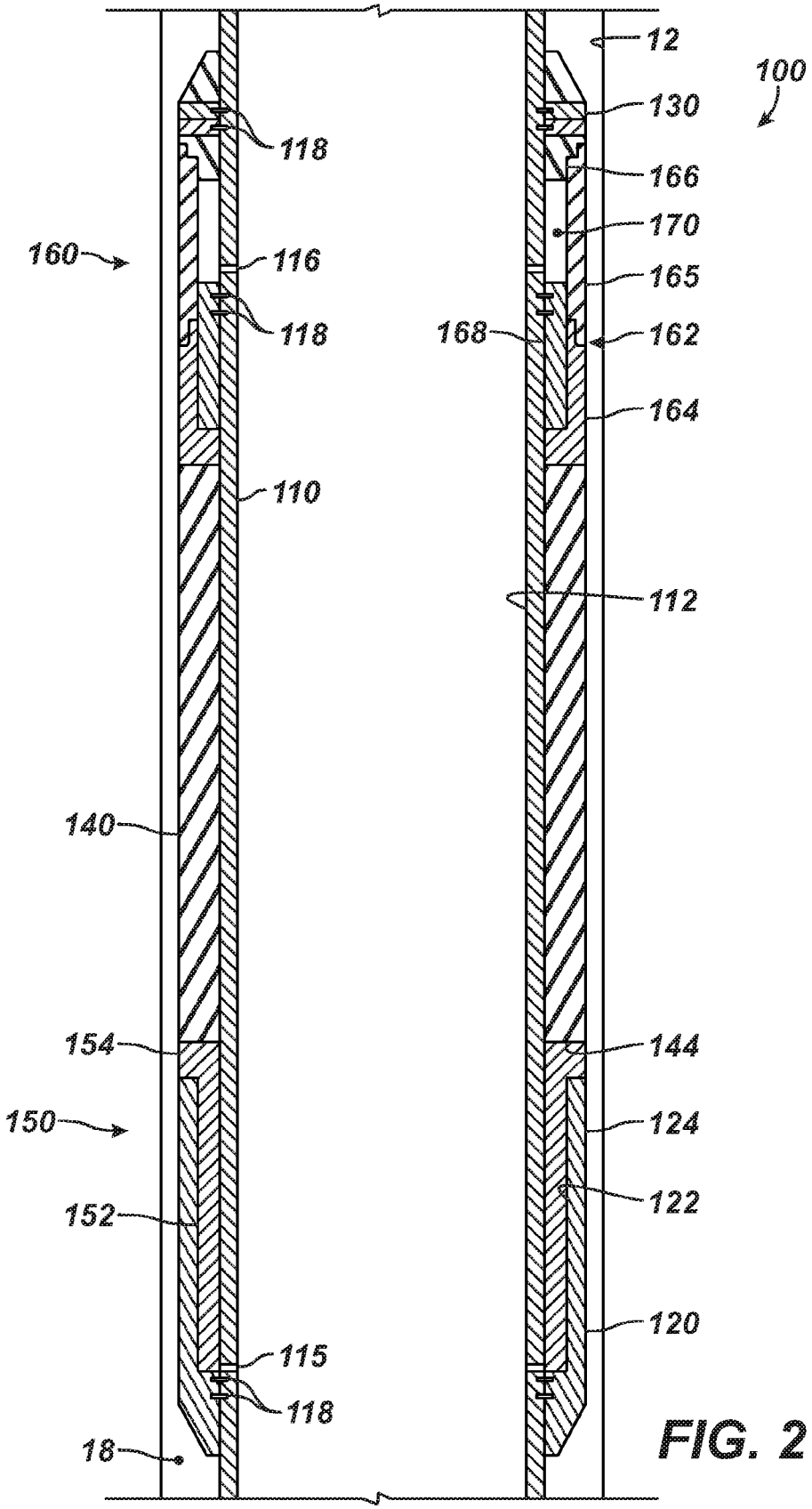
FIG. 2 depicts a double-set hydraulic packer according to the present disclosure in a run-in condition.

FIG. 2 depicts a double-set hydraulic packer 100 according to the present disclosure in an unset or run-in condition in a wellbore 12, which may be a cased or open hole. The packer 100 includes a mandrel 110 with an internal bore 112 passing therethrough that connects on a tubing string (14: FIG. 1) using known techniques. The packer 100 has first and second hydraulic setting mechanisms 150 and 160 disposed adjacent to ends of a sealing element 140. As will be appreciated, the sealing element 140 may be longer or shorter than depicted and may comprise several pieces. In fact, the sealing element 140 for the disclosed packer 100 may be considerably longer than conventional elements used on packers and can be greater than 10-in. in length depending on the implementation.

In general and as shown in FIG. 2, the first hydraulic setting mechanism 150 can be disposed on a downhole end of the packer 100, while the second hydraulic setting mechanism 160 can be disposed on an uphole end. As will be appreciated with the benefit of the present disclosure, however, a reverse arrangement can be used, depending on the implementation, orientation, and access to tubing and annulus pressures in the wellbore 12.

A first (downhole) end of the packer 100 has a first end ring 120 fixed to the mandrel 110 by lock wire 118, pins, or the like. Part of this first end ring 120 forms a first housing 124 having an inner surface, which forms a first internal cylinder chamber 122 in conjunction with the external surface of the mandrel 110. A first push rod or piston 152 resides in the first cylinder chamber 122 and has its end surface exposed to the chamber 122. Accordingly, the first push rod 152 acts as a first piston in the presence of pressurized fluid F (FIG. 3) communicated from the internal bore 112 of the mandrel 110 into the chamber 122 through one or more ports 115.

During a setting operation, for example, fluid pressure is communicated downhole through the tubing string (14: FIG. 1) and eventually enters the internal bore 112 of the packer's mandrel 110. This setting operation can be performed after run-in of the packer 100 in the wellbore 12 so that the packer 100 can be set and zones of the wellbore's annulus 18 can be isolated from one another. While the tubing pressure inside the packer 100 is increased, external fluid pressure in the annulus 18 surrounding the packer 100 remains below the tubing pressure. During this setting operation, the packer 100 begins a first setting procedure in which the first setting mechanism 150 is activated to compress the sealing element 140.

Figure 3:
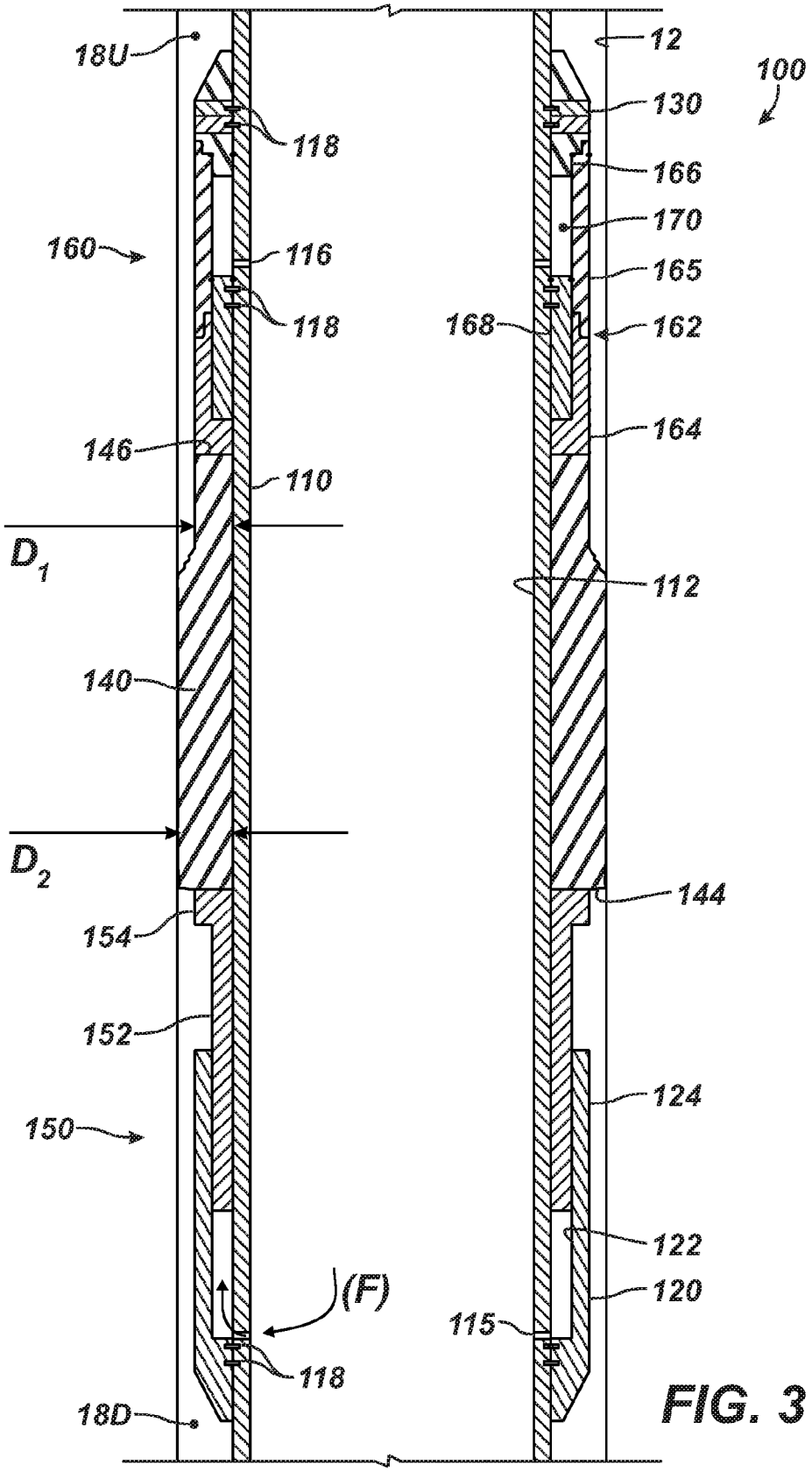
FIG. 3 depicts the double-set hydraulic packer with a first (downhole) hydraulic setting mechanism in an actuated condition.

FIG. 3 depicts the packer 100 during this first setting procedure where only the first hydraulic setting mechanism 150 is being utilized. Pressurized fluid F in the mandrel's bore 112 accesses the first piston 152 in the first cylinder chamber 122 through the one or more first ports 115 in the mandrel 110. Building in the chamber 122, the pressurized fluid F acts on the first piston 152 and forces the piston's end 154 against one end 144 of the sealing element 140 disposed on the mandrel 110. As the piston 152 moves along the mandrel 110, it longitudinally compresses the sealing element 140. In turn, as the sealing element 140 is longitudinally compressed, the element 140 radially expands from a first diameter $D_1$ to a second diameter $D_2$ toward the surrounding borehole 12.

As depicted in FIG. 3, the radial expansion is shown as occurring partially along the length of the sealing element 140. This may or may not be the case depending on the length of the sealing element 140 and the friction and other forces encountered. In any event, the radial expansion of the sealing element 140 against the wellbore 12 separates the annulus 18 into an uphole annular region 18U and a downhole annular region 18D.

As will be appreciated, fluid pressure in the mandrel 110 entering second ports 116 for the second mechanism 160 does not activate this mechanism 160, for reasons that will be apparent below. Instead, fluid pressure entering a chamber 170 of the second mechanism 160 during the first setting procedure actually tends to keep the second mechanism 160 in its original position so that the mechanism 160 acts as a fixed stop for the compression of the sealing element 140.

During setting, the increased second diameter $D_2$ tends to cause the sealing element 140 to experience an increase in friction that can eventually limit the radial expansion of the sealing element 140. In general, all or only a portion of the sealing element 140 may longitudinally compress and radially expand to a full or nearly full extent against the surrounding wellbore 12. FIG. 3 only shows partial activation for the purposes of illustration. The compression and expansion can proceed at least until the friction and any other external forces equal the force used to compress the element 140.

FIG. 3 also depicts further details of the second hydraulic setting mechanism 160 at the second end of the packer 100. A second end ring 130 is fixed to the mandrel 110 by lock wires 118 or the like is disposed adjacent to a second piston 162 of the mechanism 160. As shown, the piston 162 can be composed of several components, including a push rod end 164 connected by an intermediate sleeve 165 to a piston end 166. Use of these multiple components 164, 165, and 166 can facilitate assembly of the mechanism 160, but other configurations can be used.

The push rod end 164 of the second piston 162 is disposed against a second end 146 of the sealing element 140. On the other end, the piston end 166 is disposed adjacent to the second end ring 130, but the piston end 166 is subject to effects of fluid pressure in the uphole annular region 18U, as will be discussed further below. A fixed piston 168 is attached to the mandrel 110 by lock wire 118 to enclose the second piston chamber 170 of the second piston 162. The chamber 170 is isolated by various seals (not shown) from fluid pressure in the uphole annular region 18U formed by the packer 100 and the wellbore 12. As long as the second hydraulic setting mechanism 160 remains in an unactuated state as in FIG. 3, the chamber 170 does not decrease or increase in volume.

During operations after the first mechanism 150 is actuated and the sealing element 140 set, fluid pressure in the uphole annular region 18U may be increased, which will then actuate the second mechanism 160. For example, during a fracture treatment, operators fracture zones downhole from the disclosed packer 100 by pumping fluid pressure downhole, which merely communicates through the mandrel's bore 112 to further downhole components. The buildup of tubing pressure may tend to further set the first hydraulic setting mechanism 150, but may tend to keep the second hydraulic setting mechanism 160 unactuated, as noted above.

Then, operators isolate the packer's internal bore 112 uphole of the packer 100. For example, operators may drop a ball down the tubing string (14: FIG. 1) to land in a seat of a sliding sleeve (20: FIG. 1) uphole of this packer 100. When the sliding sleeve (20) is opened and fracture pressure is applied to the formation through the open sleeve (20), the borehole pressure in the uphole annular region 18U increases above the isolated tubing pressure in the mandrel's bore 112. However, the internal pressure in the mandrel's bore 112 does not increase due to the plugging by the set ball on the seat in the uphole sliding sleeve (20). It is this buildup of borehole pressure in the uphole annular region 18U outside the packer 100 compared to the tubing pressure inside the packer 100 that activates the second mechanism 160.

Figure 4:
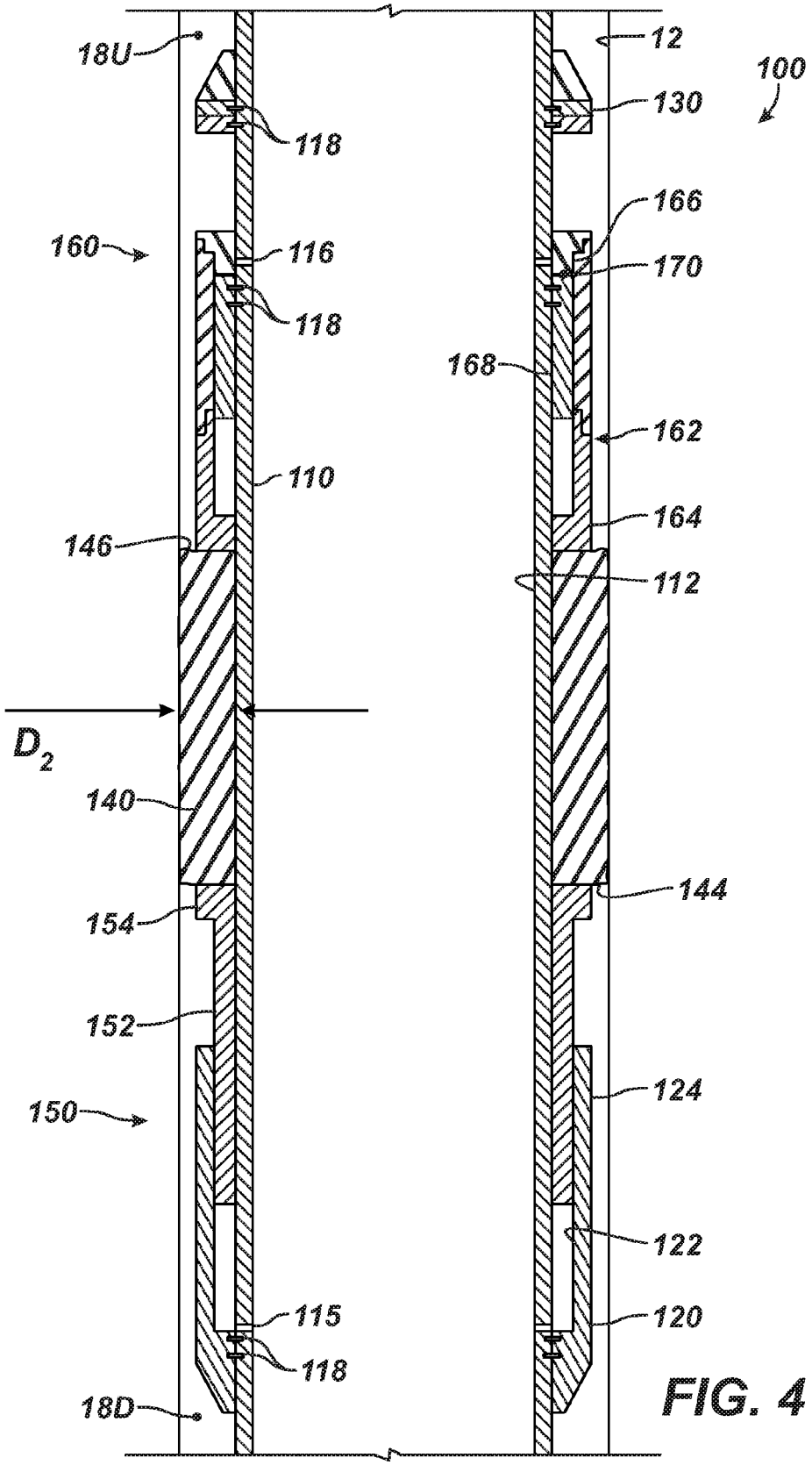
FIG. 4 depicts the double-set hydraulic packer with the downhole hydraulic setting mechanism and a second (uphole) hydraulic setting mechanism in actuated conditions.

In particular, FIG. 4 depicts the packer 100 with both the first and second hydraulic setting mechanisms 150 and 160 having been actuated. For the second hydraulic setting mechanism 160 to actuate, the tubing pressure in the inner bore 112 of the mandrel 110 is relieved, reduced, or isolated as noted above, while the borehole pressure in the uphole annular region 18U around the packer 100 is increased. In certain instances, it may not be necessary to relieve the fluid pressure in the inner bore 112 as long as the pressure in the uphole annular region 18U may be increased to overcome any pressure in the inner bore 112 to a sufficient level to actuate the second hydraulic setting mechanism 160.

With a sufficient buildup of pressure in the uphole annular region 18U, the external pressurized fluid in the region 18U acts upon the external face of the piston end 166. Chamber 170, which is at the lower tubing pressure, is sealed from the external pressure from the annular region 18U. Thus, an internal face of the piston end 166 is exposed to the lower tubing pressure in the chamber 170. Consequently, the pressure differential causes the second piston 162 to move along the mandrel 110 and exert a force against the sealing element 140.

As the second piston 162 moves, it further compresses the sealing element 140. The lower tubing pressure in the chamber 170 can escape into the mandrel's bore 112 through ports 116 while the chamber 170 decreases in volume with any movement of the second piston 162. As the piston 162 moves, it longitudinally compresses against the sealing element 140, which can radially expand further or more fully against the wellbore 12, thereby completing the radial expansion of the sealing element 140 against the surrounding wellbore 12. As noted above, the first mechanism 150 may compress the sealing element 140 practically to its full extent at least until a level of friction and other force is met. The second mechanism 160 can overcome the built-up friction to even further compress the sealing element 140, which can further radially expand the element 140.

As can be seen in the above embodiment, the packer 100 has a first hydraulic setting mechanism 150 for the sealing element 140 that uses an internal piston and cylinder arrangement moved with fluid pressure F from the interior bore 112 of the packer's mandrel 110 to at least partially set the sealing element 140. In this first setting procedure, the interior bore 112 has a high pressure, while the annulus 18 has a lower pressure. The second setting mechanism 160 remains unactivated and acts as a stop against the other end of the sealing element 140. This can be useful when fracturing a formation downhole of the packer 100, for example.

As also seen above, the packer 100 has the second hydraulic setting mechanism 160 for the sealing element 140. This second mechanism 160 has an annulus piston and cylinder arrangement moved by fluid pressure in the uphole annular region 18U surrounding the packer 100. In the second setting procedure, the second mechanism 160 is actuated when there is a higher pressure in the annular region 18U and a lower pressure in the mandrel's interior bore 112. This procedure can be useful when fracturing the formation uphole of the packer 100, for example. The two setting mechanisms 150 and 160 may have the same or different setting pressures depending on the implementation.

Having the second setting mechanism 160 allows the sealing element 140 to be set additionally, and more uniformly with more force from the opposite side, after the packer 100 has already completed a first setting procedure and engagement with the wellbore 12. Accordingly, the length of the sealing element 140 can be longer than conventionally used to seal over longer cracks in a formation. In other words, the sealing element 140 can be greater than the conventional 10-in. length usually used, and the mechanisms 150 and 160 may overcome the issues typically experienced with longer sealing elements.

The second setting procedure of the sealing element 140 can be performed when the element 140 has been allowed to cool and contract due to cold fluid flowing through the packer's mandrel 110. The second setting procedure also overcomes the friction issue encountered with longer sealing elements used on the packer 100. The second setting procedure of the sealing element 140 after it has contracted can also give the packer 100 a much better long term sealing capability. Finally, the annular pressure applied in the second setting procedure can act against a larger annular area to set the packer 100 and can provide a much higher total setting force.

Figure 5:
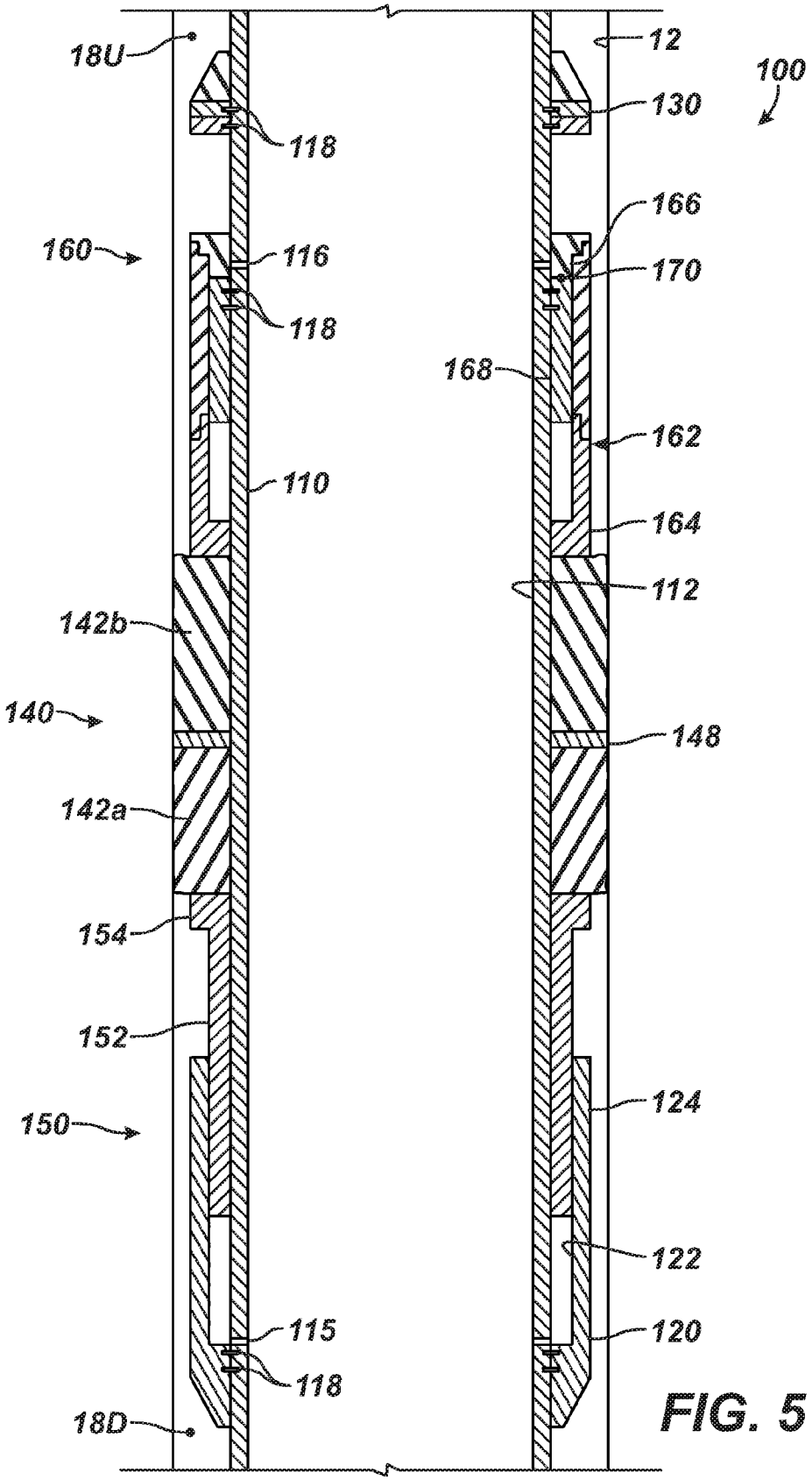
FIG. 5 depicts a double-set hydraulic packer having first and second hydraulic setting mechanisms in actuated conditions and having a barrier disposed between first and second members of a sealing element.

In certain instances, it may be desirable to isolate one end of the sealing element 140 from the other end, thereby allowing separate sealing actions to work together while each end is actuated independently. FIG. 5 depicts an embodiment of a packer 100 having a central sealing element 140 with at least two members 142*a-b* between the mechanisms 150 and 160. The first hydraulic setting mechanism 150 sets a first sealing member 142*a* of the packer's central sealing element 140, and the second hydraulic setting mechanism 160 sets a second sealing member 142*b* of the packer's element 140.

A barrier 148 isolates the first sealing member 142*a* from the second sealing member 142*b*. The barrier 148 may or may not be anchored to the mandrel 110 and can be composed of any suitable material (e.g., metal, plastic, elastomer, etc.). If the barrier 148 is anchored to the mandrel 110, the barrier 148 allows either sealing member 142*a-b* to be set without regard to the other sealing element. If the barrier 148 is not anchored to the mandrel 110, it will move with the elastomer if either mechanism 150 or 160 sets. In other words, the sealing members 142*a-b* will behave like a single element 140.

While the embodiments are described with reference to various implementations and exploitations, it will be understood that these embodiments are illustrative and that the scope of the inventive subject matter is not limited to them. Many variations, modifications, additions and improvements are possible.

For example, although not shown in the figures, the packer 100 may use any of the conventional mechanisms for locking the push rods or pistons 152 and 162 in place on the mandrel 110 once set against the sealing element 140. Accordingly, ratchet mechanisms, lock rings, or the like (not shown) can be used to prevent the rods or pistons 152 and 162 from moving back away from the sealing element 140 once set. Additionally, various internal seals, threads, and other conventional features for components of the packer 110 are not shown in the figures for simplicity, but would be evident to one skilled in the art.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A packer for a borehole, comprising:

a sealing element for sealing in the borehole, the sealing element disposed on the packer and having first and second ends;

a first setting mechanism disposed on the packer adjacent the first end of the sealing element and being hydraulically actuated with tubing pressure; and a second setting mechanism disposed on the packer adjacent the second end of the sealing element and being hydraulically actuated with borehole pressure exceeding tubing pressure;

wherein the first and second setting mechanisms sequentially compress against the first and second ends of the sealing element.

2. The packer of claim 1, wherein the packer comprises a mandrel having an inner bore; and wherein the first setting mechanism, the second setting mechanism, and the sealing element are disposed on the mandrel.

3. The packer of claim 2, wherein the first setting mechanism compresses against the first end in response to tubing pressure communicated inside the inner bore of the mandrel.

4. The packer of claim 3, wherein the second setting mechanism compresses against the second end in response to borehole pressure communicated in the borehole external to the packer.

5. The packer of claim 1, wherein the first setting mechanism comprises a first piston movable relative to the first end of the sealing element.

6. The packer of claim 5, wherein the first piston moves in response to fluid pressure communicated inside the packer and compresses against the first end of the sealing element.

7. The packer of claim 5, wherein the second setting mechanism comprises a second piston movable relative to the second end of the sealing element.

8. The packer of claim 7, wherein the second piston moves in response to borehole pressure communicated in the borehole external to the packer and compresses against the second end of the sealing element.

9. The packer of claim 1, wherein the sealing element comprises at least two sealing members, a first of the at least two sealing members disposed adjacent the first setting mechanism, a second of the at least two sealing members disposed adjacent the second setting mechanism.

10. The packer of claim 9, further comprising a barrier disposed on the packer and separating the at least two sealing members.

11. A packer for a borehole, comprising;

a mandrel having an inner bore;

a sealing element for sealing in the borehole, the sealing element disposed on the mandrel and having first and second ends;

a first piston movably disposed on the mandrel and compressing against the first end of the sealing element in response to tubing pressure communicated inside the inner bore of the mandrel; and a second piston movably disposed on the mandrel and compressing against the second end of the sealing element in response to borehole pressure communicated in the borehole external to the packer exceeding tubing pressure.

12. The packer of claim 11, wherein the first piston comprises:

a first housing disposed on the mandrel and defining a first chamber in fluid communication with the inner bore via at least one first port; and a first push rod movable relative to the first housing, the first push rod having one end exposed in the first chamber and having an opposite end disposed adjacent the first end of the sealing element.

13. The packer of claim 11, wherein the second piston comprises:

a second push rod movably disposed on the mandrel, the second push rod having one end exposed to the borehole and having an opposite end disposed adjacent the second end of the sealing element.

14. The packer of claim 13, wherein the one end of the second push rod defines a second chamber in fluid communication with the inner bore via at least one second port, the one end having an inner face exposed to the second chamber and having an external face exposed to the borehole outside the packer.

15. The packer of claim 14, wherein the second push rod moves against the second end of the sealing element when the external and internal faces experience borehole pressure in the borehole outside the packer exceeding tubing pressure inside the second chamber.

16. A method of actuating a packer in a borehole, the method comprising:

running the packer into the borehole;

actuating a first setting mechanism on the packer by pressuring up an interior of the packer with tubing pressure;

compressing against a first end of a sealing element on the packer with the actuated first setting mechanism;

actuating a second setting mechanism on the packer by pressuring up in the borehole external to the packer with borehole pressure exceeding tubing pressure; and compressing against a second end of the sealing element on the packer with the actuated second setting mechanism.

17. The method of claim 16, wherein compressing against the first end of the sealing element on the packer with the actuated first setting mechanism comprises radially expanding at least a first portion of the sealing element.

18. The method of claim 16, wherein compressing against the second end of the sealing element on the packer with the actuated second setting mechanism comprises radially expanding at least a second portion of the sealing element.

19. The method of claim 16, wherein actuating the first setting mechanism on the packer by pressuring up the interior of the packer comprises:

increasing tubing pressure in the interior of the packer; and moving a first piston in a first direction on the packer in response to the increased tubing pressure.

20. The method of claim 19, wherein actuating the second setting mechanism on the packer by pressuring up in the borehole external to the packer comprises:

increasing borehole pressure in the borehole surrounding the packer; and moving a second piston in a second direction on the packer, opposite to the first direction, in response to the increased borehole pressure.

21. The method of claim 16, wherein pressuring up in the borehole external to the packer comprise performing a treatment in a portion of the borehole adjacent the second end of the sealing element.

22. The method of claim 21, wherein performing the treatment in the portion of the borehole adjacent the second end of the sealing element comprises isolating the interior of the packer from the treatment.

23. The packer of claim 11, wherein the first and second pistons sequentially compress against the first and second ends of the sealing element.

* * * * *